US008020860B2

(12) United States Patent
Kappes et al.

(10) Patent No.: US 8,020,860 B2
(45) Date of Patent: Sep. 20, 2011

(54) DEVICES AND METHODS FOR ALIGNING AND MOVING A MEDIA SHEET WITHIN AN IMAGE FORMING DEVICE

(75) Inventors: Kristi Ann Kappes, Lexington, KY (US); David Erwin Rennick, Georgetown, KY (US); Niko Jay Murrell, Lexington, KY (US); Edward Lynn Triplett, Lexington, KY (US); Jason Lee Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/611,229

(22) Filed: Dec. 15, 2006

(65) Prior Publication Data

US 2008/0143039 A1 Jun. 19, 2008

(51) Int. Cl.
*B65H 9/04* (2006.01)
*B65H 9/14* (2006.01)

(52) U.S. Cl. ..... 271/242; 271/226; 271/228; 271/230; 271/272; 271/229

(58) Field of Classification Search ..... 271/242, 271/226, 228, 230, 229, 272
See application file for complete search history.

(56) References Cited

U.S. PATENT DOCUMENTS

| | | | | |
|---|---|---|---|---|
| 5,893,558 | A * | 4/1999 | Konig et al. | 271/264 |
| 6,241,245 | B1 * | 6/2001 | Hollar et al. | 271/314 |
| 6,315,282 | B2 * | 11/2001 | Chua et al. | 271/121 |
| 6,877,737 | B2 * | 4/2005 | Yanagi et al. | 271/121 |
| 6,953,192 | B2 * | 10/2005 | Jang | 271/213 |
| 6,987,525 | B2 * | 1/2006 | Choi | 347/262 |
| 7,080,836 | B2 * | 7/2006 | Hamada et al. | 271/274 |
| 7,168,701 | B2 * | 1/2007 | Isaka et al. | 271/273 |
| 2003/0122297 | A1 * | 7/2003 | Youn | 271/10.01 |
| 2005/0206075 | A1 * | 9/2005 | Yago | 271/272 |
| 2007/0045943 | A1 * | 3/2007 | Shibayama | 271/226 |

* cited by examiner

*Primary Examiner* — Stefanos Karmis
*Assistant Examiner* — Luis A Gonzalez

(57) ABSTRACT

The present application is directed to devices and methods for moving media sheets within an image forming device. One embodiment includes a registration mechanism located along the media path. The mechanism may include a series of discrete registration nips that each includes a pair of drive rolls and idler roll. The nips are spaced at intervals across the media path. Guide ribs are arranged across the media path and may be positioned between the nips. The guide ribs further guide the media sheets through the registration mechanism and along the media path.

10 Claims, 6 Drawing Sheets

DEVICES AND METHODS FOR ALIGNING AND MOVING A MEDIA SHEET WITHIN AN IMAGE FORMING DEVICE

BACKGROUND

The present application is directed to devices and methods of moving a media sheet within an image forming device and, more specifically, to an improved registration mechanism to align and move the media sheet along a media path within the image forming device.

Image forming devices move media sheets along a media path. The media sheets initially begin at an input area that is sized to hold a stack of sheets. Each sheet is individually picked from the stack and introduced into the media path. The media path comprises a series of roller nips, guides, and/or belts. The sheets move along the media path and through an imaging area where an image is transferred to the sheet. The media sheet is then either output from the device, or recirculated through a duplex path for receiving an image on a second side.

Media sheets are moved from the input area and into the media path in a timely manner. The distance between sheets moving along the media path is preferably minimized to increase the overall throughput of the device. The device throughput is the number of media sheets that receive a tone image and are outputted from the device within a given time period. Higher throughput devices are usually preferred by users.

The movement of the media sheets from the input area and along the media path should occur without media jams or print defects. Media jams require the user to determine the location of the jam, access and remove the jammed sheet(s), and restart the image formation process. Movement of the media sheets is also important to prevent print defects. Print defects occur when the media sheet is not properly aligned when moving through the imaging area. Misalignment may occur in the scan directions (i.e., left and right), as well as the process directions (i.e., forward and backward).

SUMMARY

The present application is directed to devices and methods for moving media sheets within an image forming device. One embodiment includes a registration mechanism located along the media path. The mechanism may include a series of discrete registration nips that each includes a drive roll and an idler roll. The nips are spaced at intervals across the media path. Guide ribs are arranged across the media path and may be positioned between the nips. The guide ribs further guide the media sheets through the registration mechanism and along the media path.

DETAILED DESCRIPTION

The present application is directed to a registration mechanism for aligning and moving media sheets as they move along a media path. The registration mechanism, generally identified as element 10, includes a series of discrete registration nips each formed by a drive roll and an idler roll. The registration nips are spaced along the width of the media path and separated by gaps. The registration mechanism 10 further includes guide ribs to guide the media sheets along the media path. The guide ribs are positioned within the gaps between the registration nips. This spacing is not possible in prior art devices that include continuous, non-discrete registration nips that are sized to extend along a majority of the media path.

Figure 1:
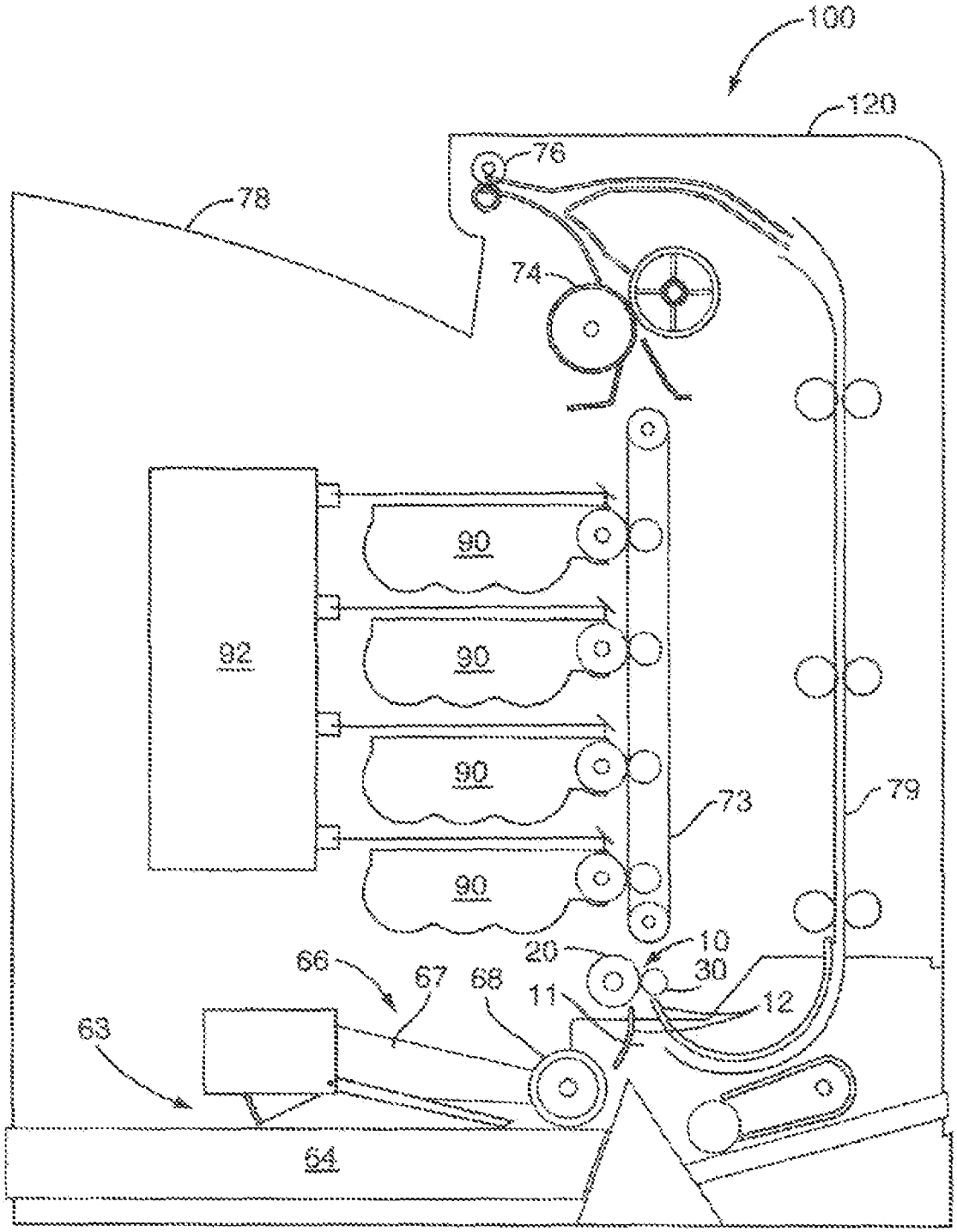
FIG. 1 is a schematic diagram of an image forming device according to one embodiment.

A better understanding of the registration mechanism 10 can be achieved when viewed within the context of image formation within an image forming device. FIG. 1 depicts a representative image forming device, such as a printer, indicated generally by the numeral 100. The image forming device 100 comprises a main body 120 with an input area 63 for holding a stack 64 of media sheets. A pick mechanism 66 moves the media sheets from the media stack 64 and into the media path 11. Pick mechanism 66 includes an arm 67 pivotally positioned in the input area 63 with a pick tire 68 positioned to contact a top-most sheet on the media stack 64. The term "pick" refers to moving the media sheet from the media stack 64 into the media path 11.

The registration mechanism 10 is positioned along the media path 11 and includes a drive mechanism 20 and an idler mechanism 30. Registration mechanism 10 aligns the media sheets prior to passing to a transport belt 73 and past a series of image forming stations 90. A print system 92 forms a latent image on a photoconductive member in each image forming station to form a toner image. The toner image is then transferred from the image forming station 90 to the passing media sheet.

Color image forming devices typically include four image forming stations 90 for printing with cyan, magenta, yellow, and black toner to produce a four-color image on the media sheet. The transport belt 73 conveys the media sheet with the color image thereon towards a fuser 74, which fixes the color image on the media sheet. Exit rollers 76 either eject the print media to an output tray 78, or direct it into a duplex 79 for printing on a second side of the media sheet. In the latter case, the exit rollers 76 partially eject the print media and then reverse direction to invert the media sheet and direct it into the duplex path 79. A series of rollers in the duplex path 79 return the inverted print media to the primary media path 11 for printing on the second side.

Figure 2:
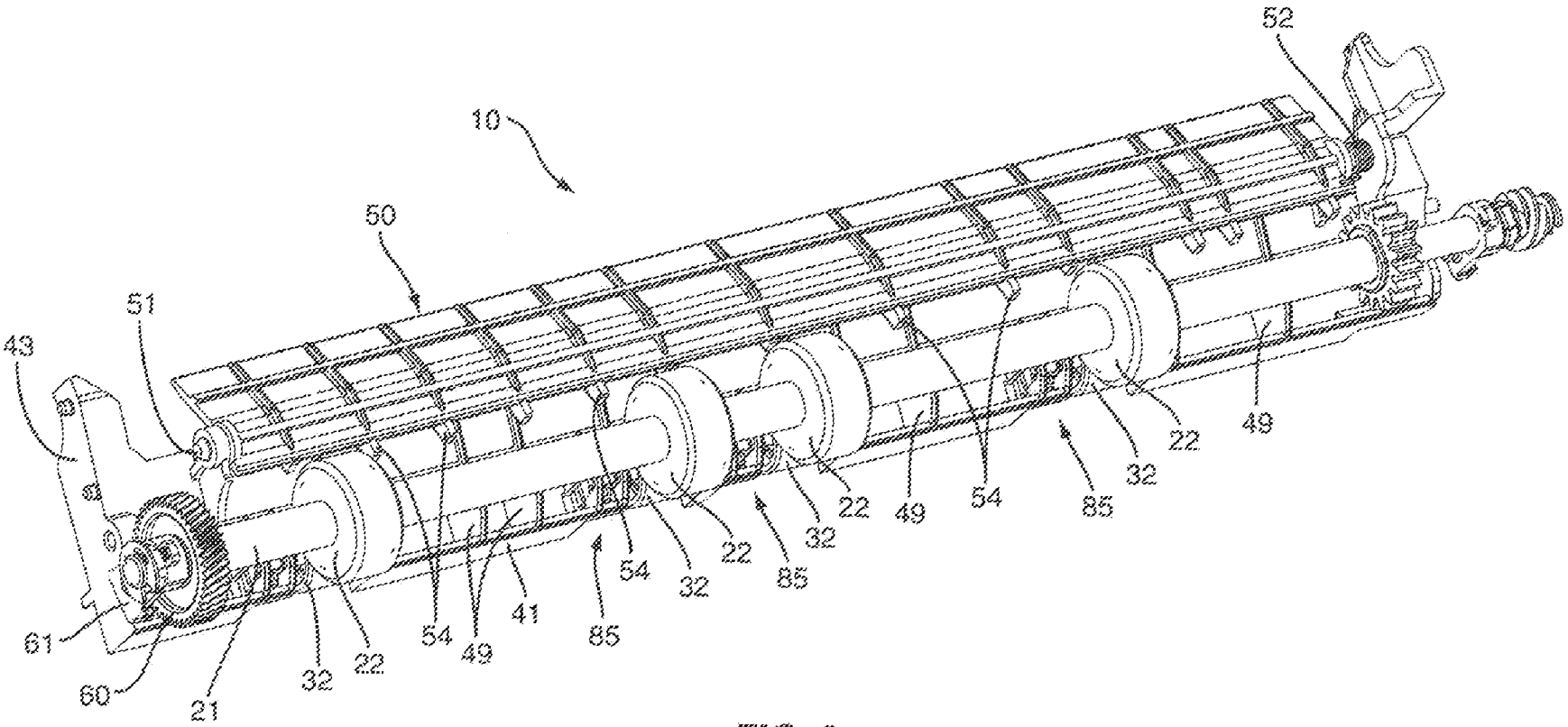
FIG. 2 is a perspective view of a first side of a registration mechanism according to one embodiment.
Figure 3:
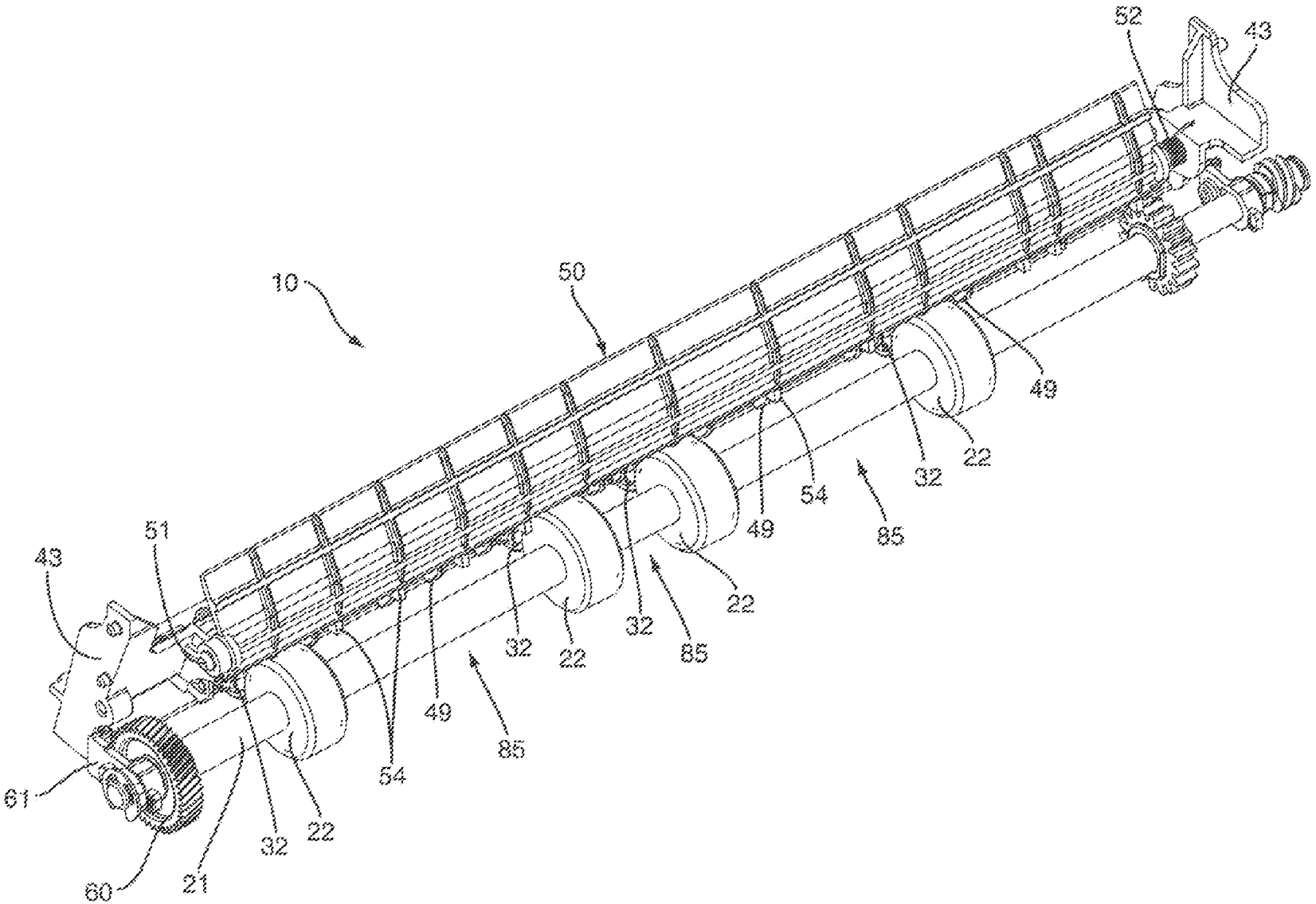
FIG. 3 is a perspective view of a first side of a registration mechanism according to one embodiment.
Figure 4:
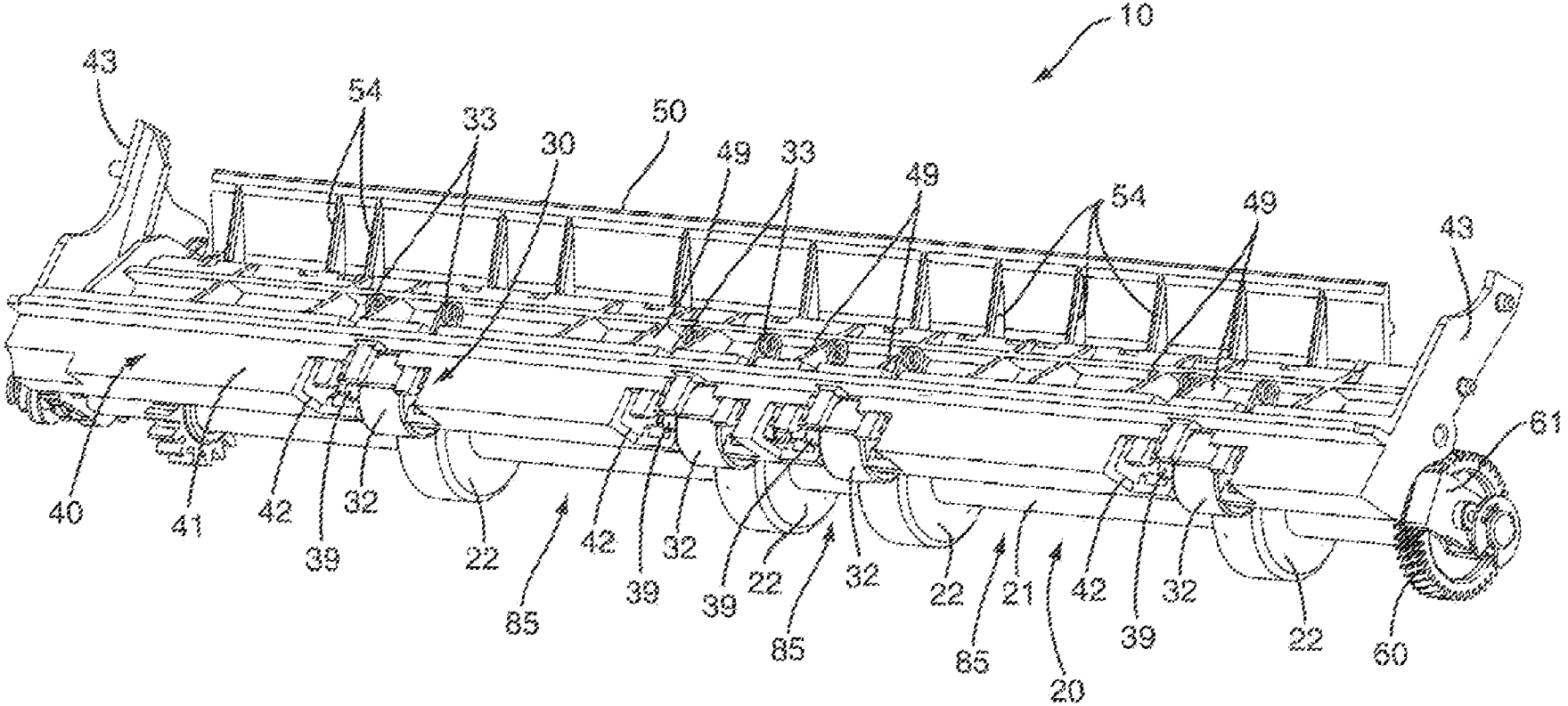
FIG. 4 is a perspective view of a second side of a registration mechanism according to one embodiment.

FIGS. 2, 3, and 4 illustrate one embodiment of the registration mechanism 10. FIGS. 2 and 3 illustrate the registration mechanism 10 from a first side, and FIG. 4 illustrates the mechanism 10 from a second side. Registration mechanism 10 generally includes a frame 40 for positioning the drive mechanism 20 and the idler mechanism 30.

Frame 40 includes a member 41 that extends between a pair of opposing side members 43. Member 41 extends across the media path 11 with the side members 43 positioned on each side of the media path 11. Member 41 includes ribs 49 that are each aligned substantially parallel to the media path 11. Each rib 49 includes a guide surface that extends into the media path 11 to contact and guide the media sheets. In one embodiment, each rib 49 includes substantially the same shape and size. In other embodiments, ribs 49 may include various shapes and sizes. Member 41 further includes cut-out sections 42 positioned along the length each sized to receive an idler roll 32.

Drive mechanism 20 includes a drive shaft 21 with drive rolls 22 spaced along the length. A drive gear 60 is attached to one end of the drive shaft 21 to receive rotational power from a gear within the image forming device 100. In one embodiment, a bearing member 61 attaches the drive shaft 21 to a side member 43 of the frame 40. Bearing member 61 may be constructed of a conductive plastic material.

An idler mechanism 30 comprising a series of idler rolls 32 is attached to the frame 40. Each idler roll 32 is positioned with one of the cut-outs within the frame member 41. In one embodiment, each idler roll 32 includes a shaft 39 as illustrated in FIG. 4. The shafts 39 fit within slots in the member 41 and allow the idler rolls 32 to rotate when contacted by the corresponding drive rolls 22. One or more biasing members 33 may be positioned to force the idlers rolls 32 against a corresponding drive roll 22.

A guide 50 is mounted to the frame 40 for guiding the media sheets along the media path 11. Guide 50 may include a shaft 51 with ends that extend outward from the lateral sides to engage with the side members 43 of the frame 40. A biasing mechanism 52 may extend between the guide 50 and the frame 40 to position the guide 50. Ribs 54 are positioned along the guide 50 and are each substantially aligned with the media path to guide the media sheets along the media path 11. As shown in FIGS. 2-4, ribs 54 are substantially parallel to each other and to ribs 49.

The drive rolls 22 and corresponding idler rolls 32 form a series of registration nips that are spaced across the media path 11. In one embodiment as illustrated in FIGS. 2, 3, and 4, four registration nips are spaced across the media path 11. The spacing of the registration nips is set to effectively move the media sheets. The spacing may be determined based on the widths of the different media that move along the media path 11. In one embodiment, registration nips are positioned to make contact towards the edges of the various media. In one embodiment, the registration nips are positioned such that each different media is contacted by at least two registration nips. Each of the registration nips are spaced apart with a gap 85 formed between the registration nips. The gaps 85 may vary in length dependent upon the spacing the registration nips.

Each of the drive rolls 22 and idlers rolls 32 includes a discrete, limited length to extend across a limited distance of the media path 11. The lengths are limited to ensure gaps 85 are formed between the registration nips. In one embodiment, the lengths of the drive rolls 22 and idlers rolls 32 are each about 10 mm. The length of each drive roll 22 and idler roll 32 may be the same or may be different. In the embodiments of FIGS. 2, 3, and 4, each drive roll 22 and idler roll 32 are substantially the same length. Further, the rolls 22, 32 that form each registration nip may be the same or may be different. In one embodiment, the length of the drive rolls 22 is larger than the idlers rolls 32.

Each of the registration nips includes a nip force created by the biasing mechanism 33 forcing the idler rolls 32 against the drive rolls 32. The force is adequate to move the media sheet along the media path 11. The force is also adequate to prevent the leading edge of the media sheets from entering into the registration nip during an alignment process when the drive and idler rolls 22, 32 are stopped or operating in a reverse direction. Further, the force is limited to allow a media sheet to be removed from the registration nips in the event of a media jam.

Figure 5:
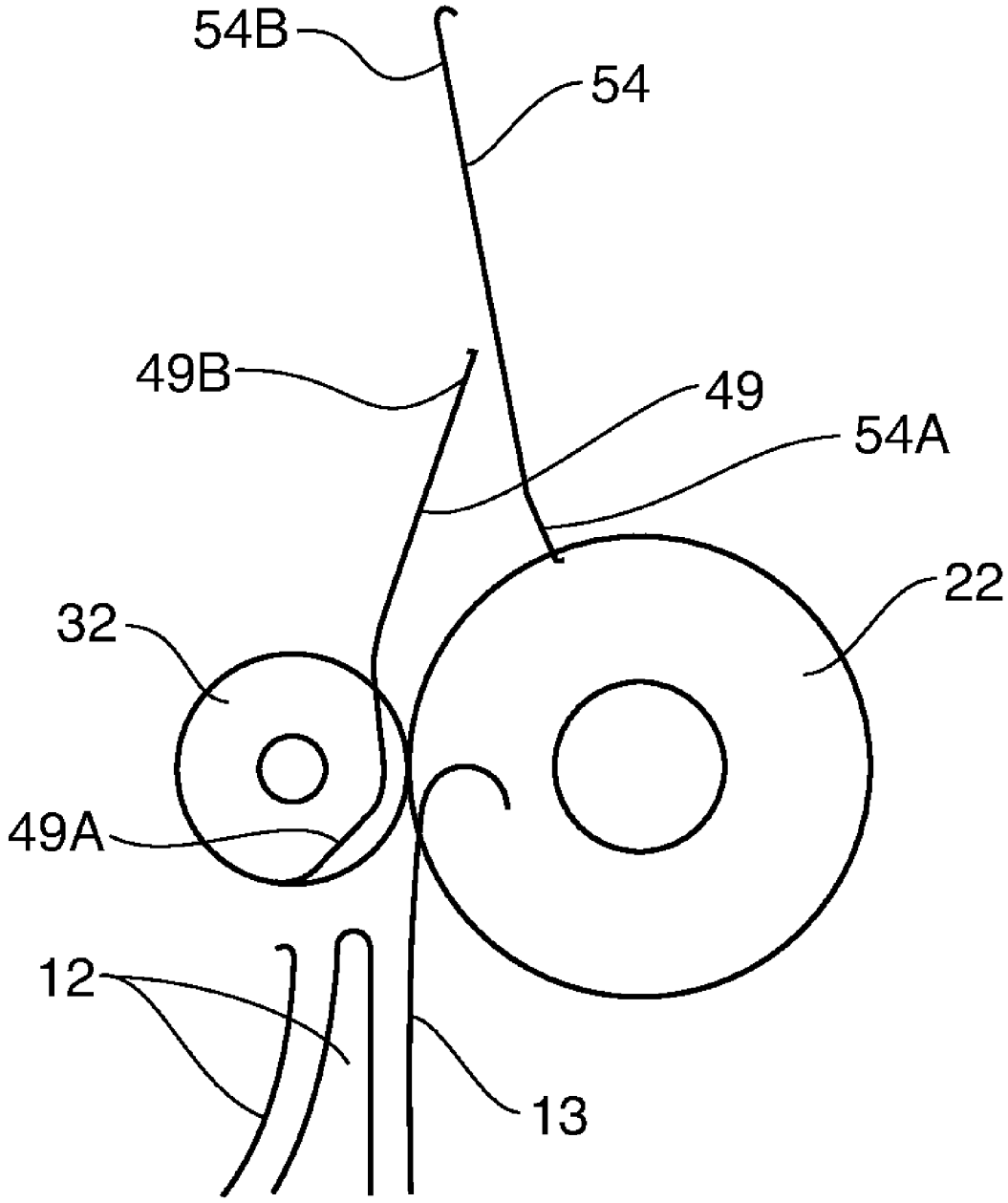
FIG. 5 is a schematic side view of a registration nip according to one embodiment.

The discrete registration nips provide for the guide 49 to be positioned within the gaps 85. This positioning is not possible in prior art devices that included a continuous registration nip. FIG. 5 illustrates a schematic side view of one of the registration nips formed between the drive roll 22 and the idler roll 32. Rib 49 is positioned within the gap 85 and extends along the lateral side of the idler roll 32. Rib 49 supports the media sheets throughout the alignment and handoff process. Media sheets with severely curled or cockled leading edge profiles enter the registration nip and align without stubbing on the drive roll 22 or catching on the guide surfaces. The spacing also reduces and/or eliminates folding of the leading edge and wrinkling of the media sheets. Further, guide 54 is positioned immediately downstream from the registration nip to direct the leading edge of the media sheet out of the registration nip and further along the media path 11. As shown in FIG. 5, guide 54 may include a leading or first end portion 54A and a second end portion 54B downstream of first end portion 54A.

Guide members 12, 13 are further positioned upstream from the registration nip to direct the leading edge. In one embodiment, members 12, 13 are formed on the input area 63 of the image forming device 100 (see FIG. 1). In one specific embodiment, members 12, 13 are positioned on a removable input tray.

Figure 6A:
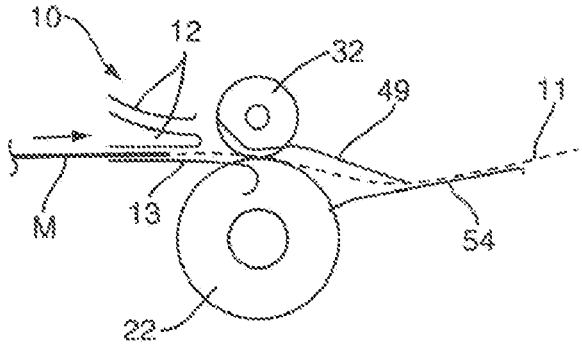
FIGS. 6A-6D are schematic side view of a bump alignment method according to one embodiment.

In one embodiment as illustrated in FIGS. 6A-6D, the registration mechanism 10 uses a bump-alignment method to align a leading edge of the media sheet as it moves along the media path 11. As illustrated in FIG. 6A, the media sheet M is moved along the media path 11 with the leading edge approaching the registration mechanism 10. The media sheet is moved by a drive mechanism upstream from the registration mechanism 10, such as the pick mechanism 66 (see FIG. 1).

Figure 6B:
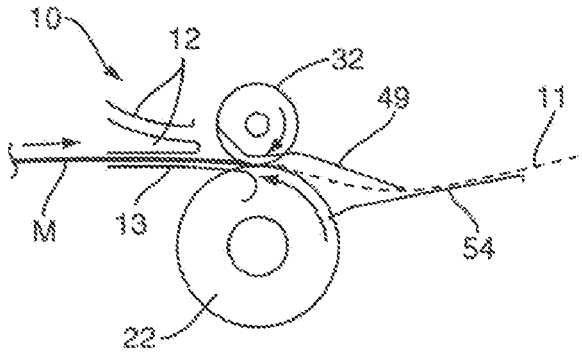

Prior to entering the registration mechanism 10, the media sheet may be skewed relative to the media path 11. Skew may be caused during the pick process, by the manner the media sheet was inserted into the input area 63, or during movement between the input area 63 and the registration mechanism 10. To remove the skew, the registration mechanism 10 stops the leading edge for a period of time while continuing to drive the sheet forward along the media path 11. As illustrated in FIG. 6B, the drive roll 22 and idler roll 32 are rotated in a reverse direction prior to the leading edge contacting the registration nip. The forward movement of the media sheet is stopped when the leading edge contacts the rolls 22, 32.

Figure 6C:
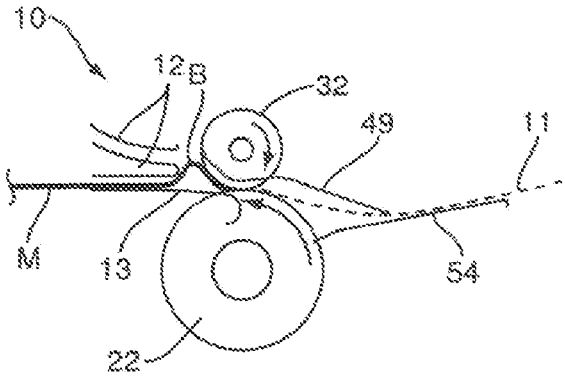

As illustrated in FIG. 6C, a bubble B is formed in the media sheet as the media sheet is continued to be moved from the input area 63 while the leading edge remains stopped. Guide 49, and in particular an upstream or first end portion 49A thereof (seen in FIG. 5), may contact and form the shape of the bubble B as the media sheet M continues to be pushed into the registration nip. The force applied to the media sheet by the upstream drive causes the leading edge to move against the registration nip and become aligned relative to the media path 11. A second end portion 49B of guide 49 is shown in FIG. 5 as being downstream of the registration nip and downstream of first end portion 54A of guide 54.

Figure 6D:
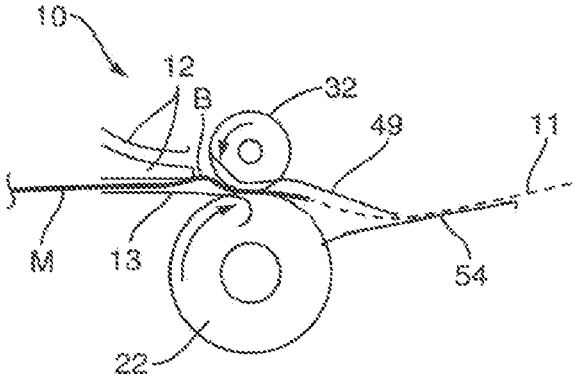

After a predetermined time period, the direction of the rolls 22, 32 is reversed to a forward direction as illustrated in FIG. 6D. This causes the leading edge of the media sheet to move through the registration nip. The leading edge is further directed by the guide 54 further downstream along the media path 11. Bubble B may remain within the sheet as it moves through the registration nip, or may be slowly dissipated due to the registration nip moving the media sheet at a greater speed than the upstream drive mechanism.

In another embodiment, the rolls 22, 32 are stationary at the time of contact with the leading edge of the media sheet. The stationary rolls 22, 32 still causes a bubble B to be formed which aligns the leading edge prior to forward motion of the rolls 22, 32 and movement of the media sheet through the nip mechanism 10.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and area also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A registration mechanism for moving media sheets along a media path within an image forming device, the registration mechanism comprising:

a frame that extends across at least a portion of the media path, the frame including guide ribs and guide member having a plurality of second ribs;

a drive shaft operatively connected to the frame and including drive rolls discretely spaced along the drive shaft, first end portions of the guide ribs extending proximal to the drive shaft such that the drive rolls are disposed along the drive shaft between the guide ribs first end portions; and a plurality of discrete idler rolls operatively connected to the frame, each of the plurality of idler rolls being aligned with a corresponding one of the drive rolls to form a series of drive nips spaced along the media path;

the drive shaft rotates in a first direction to prevent the media sheet from moving through the drive nips and to form a bubble within the media sheet that contact the guide ribs, and a second direction to move the media sheet through the drive nips, wherein the first end portions of the guide ribs being disposed upstream of the drive nips and being dimensioned for shaping the bubble in the media, and second end portions of the guide ribs being disposed downstream of the drive nips for guiding media downstream thereof;

wherein the guide member is operatively connected to the frame so that the plurality of second ribs are positioned entirely downstream from the drive nips, each of the second ribs being aligned substantially parallel to each other and substantially parallel to the guide ribs, the guide ribs being disposed along one side of the media path and the second ribs being disposed along an opposed side of the media path such that media is directed by the second end portions of the guide ribs onto the second ribs, first end portions of each second rib being upstream of the second end portion of the guide ribs and downstream of the drive nips, the first end portions of each second rib being a leading end portion thereof such that a second end portion of each second rib is downstream of the first end thereof;

wherein the guide member includes a shaft operatively coupled to the frame, and a biasing member disposed between the guide member and the frame, the guide member being integrally formed as a unitary member, and the second ribs being disposed in spaced relation to each other along the guide member.

2. The registration mechanism of claim 1, wherein the guide ribs are aligned substantially parallel to each other and aligned with the media path.

3. The registration mechanism of claim 1, wherein each of the plurality of idler rolls is positioned within a cut out in the frame.

4. The registration mechanism 1, wherein each of the plurality of idler rolls is pressed against the corresponding one of the drive rolls with a biasing mechanism.

5. The registration mechanism 1, wherein a width of each of the plurality of drive rolls and each of the plurality of idlers rolls is substantially the same.

6. A registration mechanism for moving media sheets along a media path within an image forming device, the registration mechanism comprising:

a frame that extends across at least a portion of the media path;

a plurality of nips operatively connected to the frame and spaced about the media path, each of the plurality of nips including a drive roll positioned in contact with an idler roll, the drive rolls of the nips sharing the same drive shaft, the plurality of nips being spaced apart with gaps formed between adjacent nips;

a plurality of ribs positioned along the media path and within each of the gaps formed between the adjacent nips, each of the plurality of ribs including a guide surface to direct the media sheets along the media path, a first end portion positioned upstream of the nips and a second end portion disposed downstream of the nips;

a drive shaft operatively connected to the frame and being operatively connected to the drive rolls, the drive shaft operates in a first direction prevent the media sheets from moving through the nips and to form a bubble within the media sheet that contacts the first end portions of the ribs such that the first end portions define a shape of the bubble, and a second direction to move the media sheet through the drive nips;

second guide ribs extending outward from the frame and into the media path, the second guide ribs working in combination with the plurality of ribs to guide the media sheets along the media path, each second guide rib being disposed entirely downstream of the nips and having a first end portion positioned upstream of the second end portion of the plurality of ribs, the first end portion of each second guide rib being a leading end portion thereof such that a second end portion of each second guide rib is downstream of the first end portion thereof; and a guide member formed as a unitary member from which the second guide ribs extend, and a biasing mechanism that is connected to the frame and the guide member.

7. The registration mechanism of claim 6, further including a conductive bearing member that connects the drive shaft to the frame.

8. The registration mechanism of claim 6, wherein the frame includes a series of cut-out spaces each sized to position one of the idler rolls.

9. The registration mechanism of claim 6, wherein the plurality of nips are positioned to contact a bubble formed in the media sheet when the drive shaft operates in the first direction.

10. The registration mechanism of claim 6, wherein the frame further includes lateral sides positioned along each side of the media path.

* * * * *